United States Patent [19]

Armstrong

[11] 3,936,793

[45] Feb. 3, 1976

[54] HUMIDITY AND TEMPERATURE RESPONSIVE SWITCH

[75] Inventor: William A. Armstrong, Grosse Ile, Mich.

[73] Assignee: General Motors Corporation, Detroit, Mich.

[22] Filed: Nov. 11, 1974

[21] Appl. No.: 522,474

[52] U.S. Cl. ..... 337/300; 200/61.06

[51] Int. Cl.[2] ..... H01H 37/02

[58] Field of Search ..... 337/300; 200/61.06

[56] References Cited

UNITED STATES PATENTS

| | | | |
|---|---|---|---|
| 2,267,164 | 12/1941 | Newton | 337/300 |
| 2,756,295 | 7/1956 | Schluchter | 200/61.06 |
| 3,336,119 | 8/1967 | Alban et al. | 337/300 |

*Primary Examiner*—Harold Broome

*Attorney, Agent, or Firm*—K. H. MacLean, Jr.

[57] ABSTRACT

A humidity-biased temperature responsive switch for controlling an automobile air conditioning compressor which closes at a warmer ambient temperature when the humidity is low than when the humidity is greater. The switch includes a sensor element having a metal strip and a hygroscopic plastic strip laminated together so that the different thermal coefficients of expansion will cause the free end of a cantilever-mounted sensor to move a contact. Absorption of water from the ambient air causes the plastic to swell and elongate and resultantly moves the contact into a closed position at a lower temperature than when the humidity is low.

3 Claims, 6 Drawing Figures

HUMIDITY AND TEMPERATURE RESPONSIVE SWITCH

This invention relates to a simple and economical temperature and humidity responsive switch particularly adapted for use in automobile air conditioning systems.

In an automobile air conditioning system, an electromagnetic clutch is utilized to operatively connect the engine of the automobile to the air conditioning compressor for cooling operation. Previously, a temperature responsive switch has been utilized to deactivate the compressor when the ambient temperature decreases to about 32° to 35° F. However, at ambient temperatures below about 50° to 60° F., air conditioning is unnecessary for cooling purposes and modern automobile air conditioning systems activate the compressor to an ambient temperature of about 32° F. solely for the purpose of dehumidifying incoming air. This dehumidifying operation of the air conditioner when the ambient humidity is at a low level is uneconomical.

The subject temperature and humidity responsive switch provides a switch which closes to activate the air conditioning compressor at a relatively high temperature when the humidity is low and closes at lower temperature when the humidity is high. Thus, considerable energy is conserved by deactivating the air conditioning system when it is not needed for cooling or dehumidification. The preferred embodiment of the temperature and humidity sensitive switch provides desirable operating characteristics and includes a sensor element having strips of metal and hygroscopic plastic material laminated together. The element is partially slit lengthwise into three sections and the outer sections are crimped to shorten their length. This crimping causes the middle section or portion to bend outwardly from the plane of the laminated strip. When the sensor element is supported at one end in a cantilever fashion, the free end of the sensor moves in response to different elongations of the metal and plastic due to different thermal coefficients of expansion. The free end carries a contact adapted to engage a second contact on a stationary terminal to activate the compressor clutch terminal. At a low humidity, the difference in the thermal coefficients of expansion causes movement of the free end with respect to the fixed contact and activating the air conditioning system at a predetermined high ambient temperature. When the humidity is high, the hygroscopic plastic absorbs moisture from the air and biases the free end and contact thereon toward the fixed contact. Resultantly, the switch closes at a lower ambient temperature to activate the air conditioning system for dehumidifying action. In addition, the crimped edge portions and curved central portion provide a snap action to move the free end of the strip. This provides a positive contact and greatly adds to the switch contacts.

Therefore, an object of the present invention is to provide a simple and economical temperature and humidity responsive switch utilizing a laminated metal and hygroscopic plastic material which produces a bending motion due to the difference between the coefficients of expansion of the materials and the degree of water absorption of the plastic.

A further object of the present invention is to provide a simple and economical temperature and humidity responsive switch particularly well adapted for automobile air conditioning systems in which a laminated switch element of metal and hygroscopic plastic material is exposed to an ambient air stream to produce a bending opening and closing action of the switch due to the different coefficients of expansion between the metal and the plastic and the degree of water absorption by the plastic which opening and closing activates the air conditioning compressor at a relatively high temperature when the humidity is low and at a lower temperature with increasing humidity.

A still further object of the present invention is to provide a simple and economical temperature and humidity responsive switch for use in controlling an electromagnetic clutch circuit of an air conditioning compressor including an elongated laminated sensor member of metal and hygroscopic plastic which is supported at one end in cantiliver fashion and is slit lengthwise into three portions, the outer of which are crimped to curve or bow out the middle portion, whereby the differing coefficients of expansion between metal and plastic cause the free end of the sensor element to move with a snap action so that the engagement between the switch contacts is made rapidly and positively.

Further objects and advantages of the present invention will be more readily apparent from the following detailed description, reference being had to the accompanying drawings in which a preferred embodiment of the invention is illustrated.

IN THE DRAWINGS

Figures 1, 2, 3:
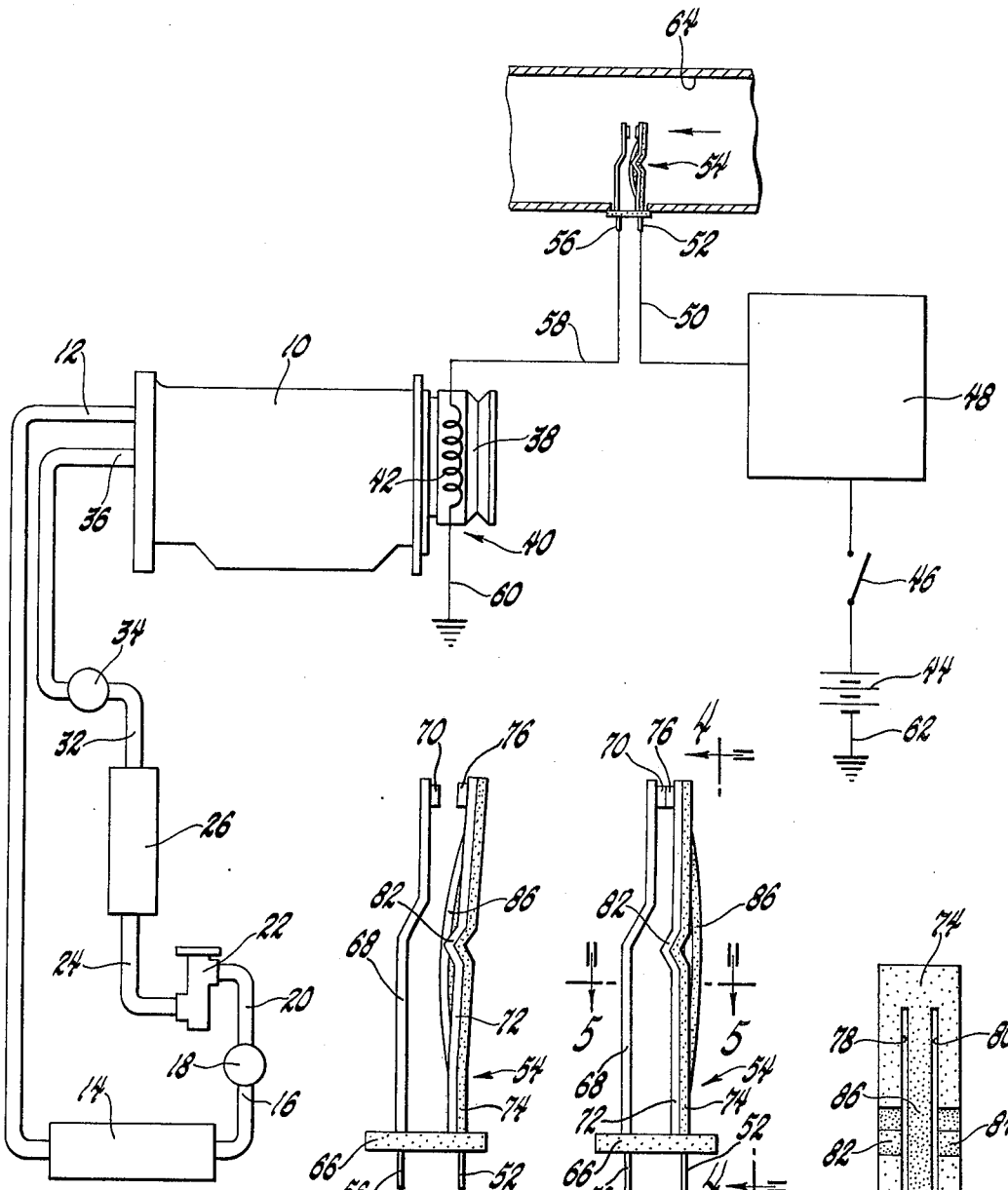
FIG. 1 is a somewhat schematic illustration of an automobile air conditioning system including the subject switch member.
FIG. 2 is an enlarged elevational view of the switch assembly shown in an open operative position.
FIG. 3 is a view similar to FIG. 2 but showing the switch in a closed operative position.

In FIG. 1, an air conditioning system typically used in automobiles is illustrated. The outlet of a refrigerant compressor 10 is connected by conduit 12 to a condenser 14 normally located in front of an automobile radiator. The condenser 14 liquifies and cools the high pressure refrigerant vapor from the compressor. From condenser 14, the refrigerant flows through conduit 16 to a receiver-dryer assembly 18. The receiver-dryer 18 separates vapor from liquid and discharges mostly liquid through outlet conduit 20. The receiver-dryer 18 also includes a desiccant member for removing any moisture which might be mixed with refrigerant in the system.

The outlet conduit 20 from receiver 18 is connected to the inlet of a thermal expansion valve 22 which regulates the quantity of refrigerant introduced through a conduit 24 into evaporator 26. The expansion valve 22 has a movable valve element therein which regulates the flow of refrigerant through the evaporator 26 to reduce its pressure to a working level for the evaporator so that air passing therethrough heats the refrigerant to vaporize it. The refrigerant passes from evaporator 26 through a conduit 32 to a suction throttling valve 34, the function of which is to maintain the temperature of refrigerant in the evaporator above about 32° F. to prevent freezing of condensate on the outer surfaces of the evaporator. From the suction throttling valve, refrigerant flows through conduit 36 to the inlet of compressor 10 where it is pressurized and once more sent through the aforedescribed fluid cycle.

The compressor 10 may be a multi-cylinder axially reciprocating piston type which is presently used in many modern automobiles. It includes a shaft extending externally from one end of a housing which is attached to a pulley 38 of an electromagnetic clutch assembly 40. The pulley 38 is adapted to be engaged by a V-belt which also engages the crankshaft of an automobile engine to rotate the compressor shaft and reciprocate the pistons therein when the electromagnetic clutch 40 is energized. Specifically, energization of the clutch 40 occurs when a coil 42 is connected in circuit with a battery 44, a master on or off switch 46, a temperature control assembly 48, a conduit 50, terminals 52 and 56 of the subject temperature and humidity responsive switch 54 and a conductor 58. Coil 42 is grounded by conductor 60 to complete the circuit with the ground 62 of battery 44. The temperature control assembly 48 may take the form of the control disclosed in U.S. Pat. No. 3,263,739 to Gaskill et al. issued Aug. 2, 1966 and assigned to General Motors Corporation.

The temperature and humidity responsive switch 54 in FIG. 1 is located in the inlet air passage defined by duct 64. Ambient air is passed by duct 64 into the automobile ventilation system and hence through the evaporator 26 before its discharge into the passenger compartment.

Specific details of the switch assembly 54 are best shown in FIGS. 2–5 in which a preferred embodiment is illustrated. The switch 54 includes a base 66 for mounting purposes and from one side of which terminals 52, 56 extend. A relatively rigid and therefore stationary terminal member 68 extends from the other side of base 66 and supports a stationary contact 70 at its end. Member 68 may be made of any rigid and conductive material such as steel or brass. Adjacent to member 68 and spaced therefrom is a laminated switch element or sensor including a metal strip member 72 and a hygroscopic plastic member 74. The materials are bonded together so that an expansion of one affects the other. One end of the switch element is supported in a cantilever fashion by base 66 while the other end is free to move in duct 64. A contact member 76 thereon is supported on the free end.

Figure 4:
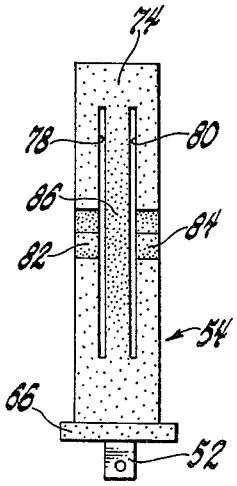
FIG. 4 is another elevational view of the switch assembly shown in FIG. 2 and looking in the direction of section line 4—4 in FIG. 3.
Figure 5:
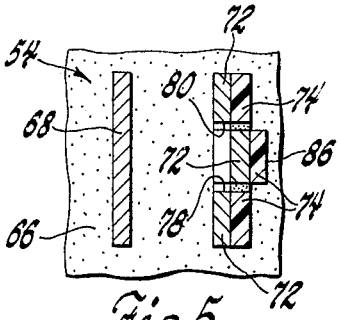
FIG. 5 is a fragmentary sectioned view of the switch assembly taken along section line 5—5 in FIG. 3 and looking in the direction of the arrows.

The laminated switch element has slots 78, 80 which extend lengthwise through the laminated strip to divide the midportion of the strip into three distinct elements as shown in FIG. 4. The two outer portions are crimped at 82 and 84 to reduce their length. The crimping causes the middle or central portion 86 to bend outward from the plane of the laminated switch element. This outward bend or curve causes the contact 76 on the strip to be moved slightly away from the fixed contact 70 when below the closing temperature and toward it when above the closing temperature. FIG. 2 shows the switch 54 in an open operative position. With increasing temperatures, the relatively greater rate of expansion of the plastic causes the curved portion 86 to move toward the right and eventually to snap in that direction into the closed position shown in FIG. 3. This causes an appreciable movement of the contact 76 to the left into engagement with fixed contact 70, thus energizing the compressor electromagnetic clutch coil 42.

Figure 6:
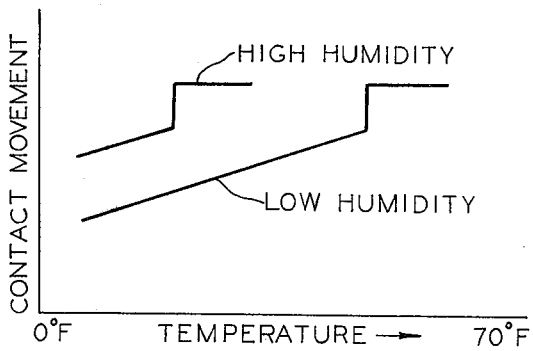
FIG. 6 is a plot of the switch movement versus temperature increases for two humidity conditions.

The use of a hygroscopic plastic material for the portion 74 of the switch element 54 produces desirable changes in switch operating characteristics with humidity changes. Materials such as Nylon and cellulastic materials exhibit moisture absorption characteristics desirable for the subject application. When the plastic portion 74 of the switch element absorbs moisture from the air, the plastic swells and elongates. With the illustrated orientation of the metal side 72 and the plastic side 74 shown in FIGS. 2 and 3, the contact 76 is moved toward the fixed contact 70 when the plastic absorbs moisture. Thus the switch requires less of a temperature change to close and it will close at a lower temperature in response to increased humidity conditions. A representative illustration of switch operation is shown in FIG. 6, which is a representation of expected movement of the contact 76 with increasing temperature in a low humidity atmosphere and also in a high humidity atmosphere. The vertical discontinuity in the plot occurs when the central portion 86 of the switch element rapidly shifts from one side to the other to produce a snap action. The snap action rapidly and positively engages the contacts and thus increases their life by minimizing sparking.

The above-detailed description and the accompanying drawings disclose a preferred embodiment of the switch but it should be apparent to one skilled in the arts that modifications can be made to the switch structure without deviating from the invention, which is described in the following claims.

What is claimed is as follows:

1. A temperature and humidity responsive switch comprising: a base member; an elongated stationary member with one end attached to said base member and a second end supporting a contact; an elongated bendable switch element having one end attached to said base member and a movable second end supporting a contact in alignment with the contact on said stationary member so as to cause engagement of said contacts when the second end of the switch element moves toward said stationary member during bending of the switch element; said switch element having a laminated structure with a metal portion and a plastic portion bonded together in a manner so that differences in their respective coefficients of thermal expansion affect the position of the movable second end of said switch element with respect to said second end of the stationary member; said elongated switch element being separated by slot means into side by side strip portions whose end portions adjacent said movable second end are joined and whose mid-portions are movable in the lateral direction with respect to one another; at least one of said strip portions being shortened in length, thereby causing the middle of the remaining strip portion to bend laterally in one direction from the general plane of the switch element during a low range of ambient temperatures and to cause the contact on the movable second end of the switch element to be positioned away from the contact on said second end of said stationary member and subsequently causing the middle portion to pass through the plane of the switch element and to bend in an opposite lateral direction with increasing ambient temperatures due to the differences in thermal coefficients of the metal and plastic so as to cause the contact on the second end of the switch element to engage the contact on the stationary member in a rapid and positive manner.

2. A temperature and humidity responsive switch comprising: a base member; an elongated stationary member with one end attached to said base member and a second end supporting a contact; an elongated bendable switch element having one end attached to said base member and a movable second end supporting a contact in alignment with the contact on said stationary member so as to cause engagement of said contacts when the second end of the switch element moves toward said stationary member during bending of the switch element; said switch element having a laminated structure with a metal portion and a plastic portion bonded together in a manner so that differences in their respective coefficients of thermal expansion affect the position of the movable second end of said switch element with respect to said second end of the stationary member; said switch element having slots therethrough extending lengthwise, separating the midportion of said switch element into three strip portions; the two outer strip portions being crimped to shorten their length, thereby causing the middle unshortened strip portion to bend laterally outwardly in one direction from the plane of the switch element during a low range of ambient temperatures to cause contact on the movable second end of the laminated switch element to be positioned away from the contact on said second end of the stationary member and subsequently causing the middle portion to pass through the plane of the switch element and bend in an opposite second direction with respect to the plane of the switch element with increasing ambient temperatures due to the differences in thermal expansion coefficients of the metal and plasitc so as to cause the contact on the second end of the switch element to engage the contact on the stationary member in a rapid and positive manner; said plastic portion exhibiting hygroscopic properties which cause said plastic portion to swell and elongate when moisture is obsorbed due to increasing humidity, whereby the position of said movable second end of said switch element with respect to said stationary member changes in response to humidity changes; said metal portion having a lower coefficient of thermal expansion than said plastic portion and being located between said stationary member and said plastic portion to cause movement of the second end of the laminated switch element and resultant engagement of the contacts with increasing ambient temperatures; the outer placement of said plastic portion of the laminated switch element with respect to said stationary member causing the contact engagement to take place at a lower ambient temperature at a relatively high humidity due to the swelling and elongation of said hygroscopic plastic.

3. A temperature and humidity responsive switch comprising: base support means for an elongated stationary member, one end of which is attached to said support, the second end of which is spaced from the plane of said support and has an electrical contact thereon; a laminated switch element, one end of which is supported by said base means, the remainder extending therefrom in substantial parallelism with said stationary member; said laminated switch element having a metal portion bonded to a hygroscopic plastic portion to produce a unitary switch element including diverse materials with different thermal coefficients of expansion; an electrical contact on the second end of said laminated switch element and oriented with respect to the electrical contact on said stationary member so that the contacts engage when the laminated element bends and places the switch in a closed operative mode; said laminated switch element being separated into three independently movable portions by slots extending in a lengthwise direction; the two outer portions being crimped to reduce their length and to cause the other portion to curve from the plane of said laminated element whereby the difference in coefficients of expansion between the metal and the plastic causes rapid movement of the second end of the laminated element to engage the contacts in response to an increase in ambient temperature while simultaneously the absorption of moisture by the plastic portion of the laminated element due to humidity increases, biases the second end of the laminated element toward the fixed contact so that the switch will close at a lower ambient temperature when the humidity is high than when the humidity is low.

* * * * *